United States Patent [19]

Strudel Werner et al.

[11] Patent Number: 4,947,529

[45] Date of Patent: Aug. 14, 1990

[54] EXPANDER FOR TUBULAR FABRIC

[75] Inventors: Strudel Werner, Friedrichshafen; Oliver Hostenkamp, Lindau, both of Fed. Rep. of Germany

[73] Assignee: Lindauer Dornier Gesellschaft mbH, Lindau, Fed. Rep. of Germany

[21] Appl. No.: 395,778

[22] Filed: Aug. 18, 1989

[30] Foreign Application Priority Data

Aug. 18, 1988 [DE] Fed. Rep. of Germany ..... 3828094

[51] Int. Cl.[5] ..... D06C 5/00; B29C 55/28; B29C 53/10; B29D 23/00

[52] U.S. Cl. ..... 26/84; 26/83

[58] Field of Search ..... 26/83, 84

[56] References Cited

U.S. PATENT DOCUMENTS 2,130,118 9/1938 Cohn ..... 26/84
3,175,272 3/1965 Cohn et al. ..... 26/84

FOREIGN PATENT DOCUMENTS 204660 12/1986 European Pat. Off. .
267880 5/1988 European Pat. Off. .
2823978 12/1979 Fed. Rep. of Germany .

*Primary Examiner*—Werner H. Schroeder
*Assistant Examiner*—Bradley Kurtz DeSandro
*Attorney, Agent, or Firm*—W. G. Fasse; D. H. Kane, Jr.

[57] ABSTRACT

An expander for tubular fabric is described having roller arrangements provided left and right in a frame for flat spreading of the tubular fabric, whereby each roller arrangement has a driven drive roller, which bears on the inside of a guide roller around which the tubular fabric is laid. The drive roller in turn is supported by a support roller also arranged on the inside. Thus, a trouble-free transport of the tubular fabric in the expander is assured by the drive roller's position between the guide roller and the support roller.

7 Claims, 5 Drawing Sheets

EXPANDER FOR TUBULAR FABRIC

FIELD OF THE INVENTION

The invention relates to an expander for tubular fabrics. Such expanders are used in the textile manufacturing industry. An expander of the present type is especially suitable for use in combination with mercerization equipment.

BACKGROUND INFORMATION

European Pat. Publication No. 267,880 describes an expander for tubular fabric with a frame to which is secured on both sides, right and left, respectively, at least one roller-arrangement each including one outer guide roller around which the tubular fabric is laid. The roller-arrangement spreads the tubular fabric, whereby a drive roller driven for rotation bears with a frictional contact against the guide roller through the tubular fabric for transporting the tubular fabric. The known apparatus includes at least one support roller which takes up tension applied by the tubular fabric to the guide roller. Due to the fact that the drive roller bears against the outside of the guide roller through the tubular fabric, there is the disadvantage that the tension which is applied by the tubular fabric to the guide roller reduces the friction contact between the guide roller and the drive roller so that in operation frequently the friction contact becomes insufficient for an efficient feed advance of the tubular fabric along the expander. As a result, the guide roller and thus the tubular fabric are no longer driven in a continuous fault-free manner, whereby creasing may result.

In order to avoid the just outlined problems, there are provided support rollers which are in a slanted position and bear against the inside of a beaded profile of the guide roller. However, the support rollers of this type merely aggrevate the problem because the support rollers are also driven by frictional contact so that the bearings of the support rollers are loaded which in turn causes a respective delaying or counteracting force that is effective on the tubular fabric to be transported. As a result, the tubular fabric has a tendency to assume a wavy configuration and to sag or crease.

German Pat. Publication No. 2,823,978 discloses an expander for tubular fabric, wherein the expander comprises on its inside a pair of guide rollers which are driven by a drive roller provided for both guide rollers in common. The drive roller causes the tubular fabric to contact the guide rollers similar to the arrangement of the above mentioned European Patent Publication, namely so that the tubular fabric contacts the outside of the guide rollers. As a result, the problem is again not avoided that in the operation the tension applied by the tubular fabric to the guide rollers has a tendency to diminish or even interrupt the friction and hence the force contact or force transmission between the drive rollers and the guide rollers, so that corrugated configurations of the fabric and sagging cannot be satisfactorily avoided.

European Pat. Publication No. 204,660 discloses an expander equipped with endless transport belts meshing or engaging feed advance rollers in a releasable manner. Further, means are provided for changing the width of the expander while the tubular fabric passes over the expander. The change of the expander width is to be accomplished from the outside without interference by the advancing fabric.

OBJECTS OF THE INVENTION

In view of the above it is the aim of the invention to achieve the following objects singly or in combination:

to construct an expander in such a way that the above disadvantages are avoided, specifically to assure a continuous smooth feed advance of the tubular fabric without sagging and without unwanted changes in the configuration of the tubular fabric;

to construct an expander in such a way that its width is adjustable to accommodate tubular fabrics of different widths;

to arrange the support roller and the guide roller in such a way relative to each other that an especially smooth transport of the fabric is assured without causing any creases in the fabric;

to construct an expander in such a way that it is suitable for cooperation with a mercerizing equipment; and to free the friction contact exerted by the drive roller on the guide rollers from any tension to which the fabric is exposed so as to avoid any influence by said tension on the driving force that is transmitted by friction.

SUMMARY OF THE INVENTION

The roller arrangement for an expander according to the invention is such that the drive roller, relative to the frame, bears against the inside of the guide roller and that the drive roller is supported by the support roller which bears against the circumference of the drive roller on a side facing away from the guide roller.

The arrangement of the rollers according to the invention has the advantage that the tension exerted by the tubular fabric on the guide roller even increases the frictional contact and force transmission between the drive roller and the guide roller so that the tubular fabric is transported through the expander continuously without jamming nor creasing. Such continuous transport without any jamming takes place over the entire surface area of the tubular fabric presently travelling over the expander. The guide roller and the support roller are located in the same plane so that any distortion or warping of the fabric by angularly arranged support rollers is not possible in a roller arrangement according to the invention.

In the simplest embodiment according to the invention a single guide roller cooperates with a single support roller arranged in such a way that the support roller is located behind the guide roller in a direction extending perpendicularly to the transport direction of the tubular fabric. However, a preferred embodiment comprises two guide rollers spaced from one another with a support roller arranged symmetrically to the guide rollers and behind the guide rollers. In such an arrangement with a single support roller behind two guide rollers, the latter assure an especially smooth transport of the fabric through the expander, thereby keeping the fabric free of creases. This type of arrangement is especially suitable for use in combination with mercerizing equipment, whereby the expander would be located at the input end of the mercerizing machine.

For the mercerizing purpose it is also preferred to provide at least two roller arrangements on each side of the frame and one behind the other as viewed in the transport direction of the tubular fabric. Thus, a total of four roller arrangements are used which assure an especially smooth, unimpeded, and continuous transport of the tubular fabric through the expander.

Preferably, two drive rollers are arranged one on each side of the plane defined by the guide roller and by the support roller, so that the rotational axes of the drive rollers extend in parallel to this plane. In other words, the drive rollers should be arranged with their rotational axes at a right angle to the rotational axes of the support and guide rollers so that the guide rollers are supported by the support rollers through the circumference of the drive rollers.

According to an important embodiment of the invention each side of the frame is equipped with its own drive system for the drive rollers. This type of arrangement makes it quite easy to change the working width of the expander.

It has been found that a particularly efficient force transmission is achieved by frictional contact between the rollers if the circumferential surface of the rollers are constructed as slanted surfaces.

BRIEF DESCRIPTION OF THE DRAWINGS

In order that the invention may be clearly understood, it will now be described by way of example, with reference to the accompanying drawings, wherein.

DETAILED DESCRIPTION OF PREFERRED EXAMPLE EMBODIMENTS AND OF THE BEST MODE OF THE INVENTION

Figure 1:
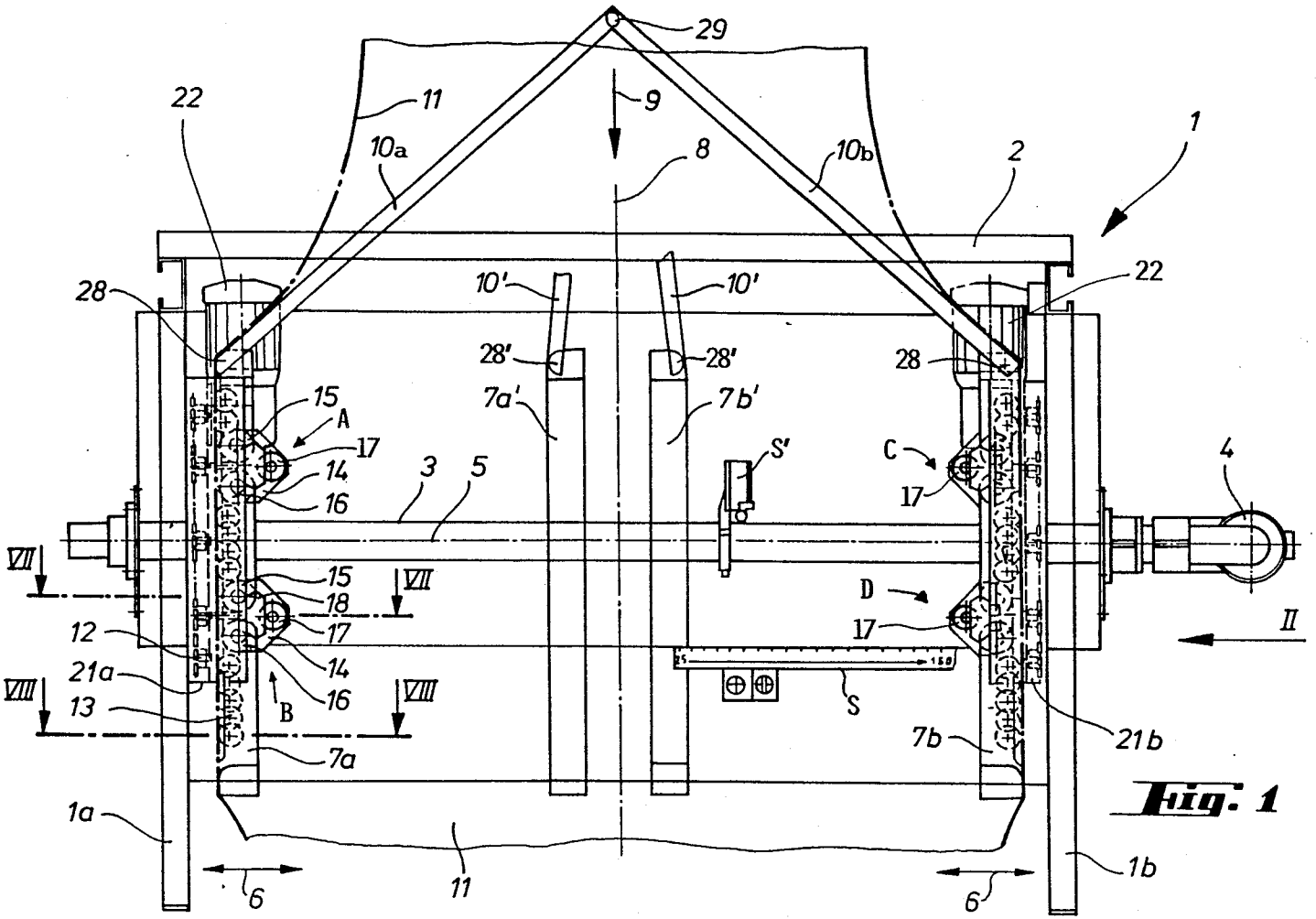
FIG. 1 is a schematic front view of an expander according to the invention, whereby the viewing direction extends substantially perpendicularly to the broad surface of the expanded tubular fabric.

FIG. 1 illustrates an expander, more specifically a so-called flat expander according to the invention arranged at the inlet end of a mercerizing machine, not shown in FIG. 1. The tubular fabric 11 to be expanded travels in the direction of the arrow 9 through the expander. In other words, the inlet end of the expander is shown at the top of FIG. 1 and the outlet end is at the bottom of FIG. 1. The expander comprises a portal type of frame 1 having uprights 1*a* and 1*b* interconnected by cross-beams 2. The uprights 1*a* and 1*b* and the cross-beam 2 form essentially an inverted U-configuration with the uprights 1*a*, 1*b* forming the legs and the cross-beam 2 forming the base of the U-configuration.

An adjustment mechanism 3 for adjusting the width of the expander is mounted to the uprights 1*a* and 1*b*. The width adjustment is accomplished by a drive mechanism driven by a motor 4 which rotates a spindle 5 to be described in more detail below.

The expander comprises, for example, four roller arrangements A, B, C, and D. The roller arrangements A and B form a pair mounted on an expander section 7*a*. The roller arrangement C and D form a pair mounted on an expander section 7*b*. Each expander section 7*a*, 7*b* has a frame section 21*a*, 21*b* with a spindle nut, not shown since it is conventional. The spindle nut is rigidly secured to the respective expander frame section 21*a*, 21*b* for engaging the spindle 5. The spindle 5 is threaded along half its length with a threading in one direction and along its other half with a threading in the opposite direction so that rotation of the spindle 5 in one direction brings the expander sections 7*a* and 7*b* toward each other and away from each other when the spindle 5 rotates in the opposite direction. Movement of the expander sections 7*a* and 7*b* toward and away from each other is indicated by the arrow 6 in FIG. 1. The closest position of the expander sections 7*a*, 7*b* to each other is shown at 7*a*′ and 7*b*′ in FIG. 1. A scale S is arranged to directly indicate the spacing of the expander sections 7*a*, 7*b* from each other, thereby also indicating the spread of the expander. The adjustment of the expander sections 7*a* and 7*b* relative to each other is always such that the expander sections 7*a* and 7*b* extend exactly in parallel to each other. For this purpose the expander sections 7*a* and 7*b* are respectively guided along the adjustment mechanism 3 by conventional means not shown in detail.

The inlet end of the expander 1 comprises two guide rails or tie bars 10*a* and 10*b* pivoted at 28 to the respective expander section 7*a*, 7*b*. The guide rails or tie bars 10*a*, 10*b* are pivoted to eaeh other at 29 to form a tip. Thus, the guide rails or bars 10*a* and 10*b* positively guide the oncoming tubular fabric 11 into the expander 1, thereby preventing that the fabric 11 can sag between the expander sections 7*a* and 7*b* while travelling in the direction of the arrow 9.

FIG. 1 further shows the large adjustment range of the two expander sections 7*a* and 7*b* relative to each other. As mentioned, positions 7*a*′ and 7*b*′ show an example of the expander sections at a close spacing from each other, whereby a relatively small tubular fabric width of, for example 270 mm can be achieved while the maximum tubular width is only limited by structural considerations. Achieving the just mentioned small expander width is accomplished easily according to the invention, because the telescoping rods required in the prior art are avoided according to the invention. Basically, the minimal spacing or expander width would be determined when the two sections 7*a*, 7*b* contact each other.

Figure 2:
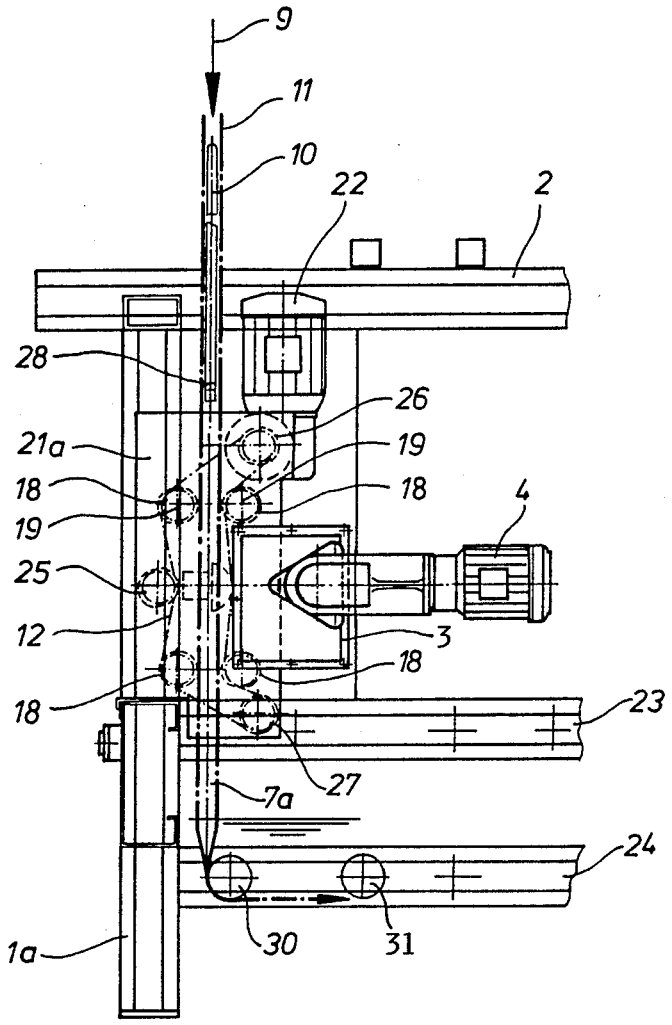
FIG. 2 is a side view in the direction of the arrow II in FIG. 1.

The left side with the roller arrangements A and B is substantially a mirror-symmetrical image of the right side with the roller arrangements C and D. Therefore, only one side will be described in the following. In fact, the left side is substantially a mirror-symmetrical image of the right side relative to the center line 8 in FIG. 1, except for the scale S with its illuminating device S′. Thus, the following description for the expander section 7*a* with its roller arrangements A and B is the same as that for the expander section 7*b* with its roller arrangement C and D. As shown in FIG. 2, the expander section 7*a* carries a chain drive including a drive chain 12 running around sprocket wheels 26 and 27. The sprocket wheel 26 is driven by a motor 22 also mounted on the expander section 7*a*. The sprocket wheel 27 is an idler wheel.

Figure 4:
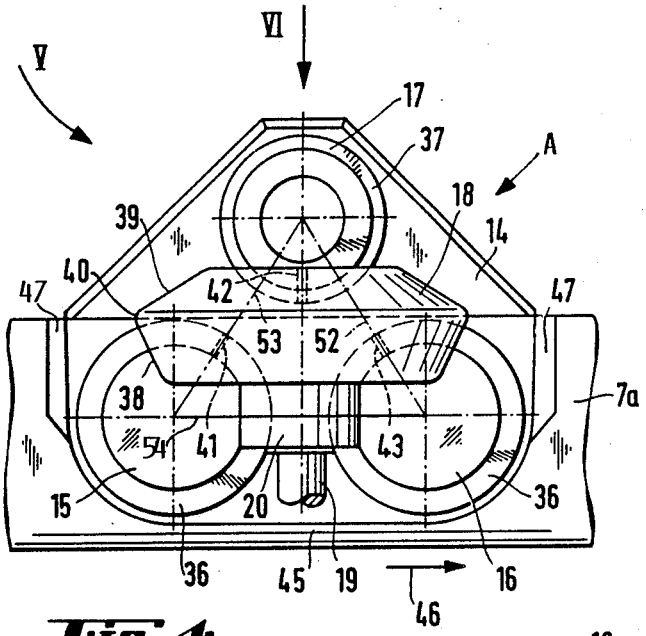
FIG. 4 is a view of a roller arrangement including the roller mounting components substantially in the same direction as seen in FIG. 1, but on an enlarged scale.

A position adjustable sprocket wheel 25 serves for tensioning the drive chain 12. Please see FIG. 2. The drive chain 12 drives driven drive rollers 18 of which there are four, as best seen in FIG. 2, on each side of the expander. Referring briefly to FIG. 4, each drive roller 18 is mounted in a bearing 20 in the expander section 7*a*. Each drive roller 18 has a drive shaft 19 rigidly connected to a sprocket not shown, but engaged by the drive chain 12. The drive shafts 19 extend in parallel to each other, but at a right angle to the rotational axes of the rollers 15, 16, 17.

Each flat spreader or rather roller arrangement A, B, C, D comprises a roller mounting plate 14. The roller mounting plates 14 of the roller arrangements A and B are arranged at a vertical spacing from each other. Similarly, the mounting plates 14 of the arrangements C and D are vertically spaced from each other at the same vertical spacing. Each mounting plate 14 carries, for example, three rollers mounted to a plate in a fixed position, but rotatable about a fixed axis. A set of three rollers comprises, for example, the guide rollers 15 and 16 and one support roller 17. Plate 14 is secured to the expander section 7*a*.

Figure 5:
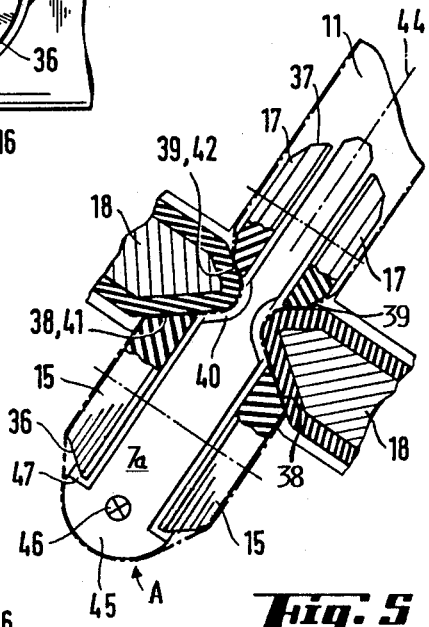
FIG. 5 is a view substantially in the direction of the arrow V in FIG. 4 and showing the pair of drive rollers partially in section and partially broken away and further illustrating the location of the rollers relative to a roller mounting plate.
Figure 6:
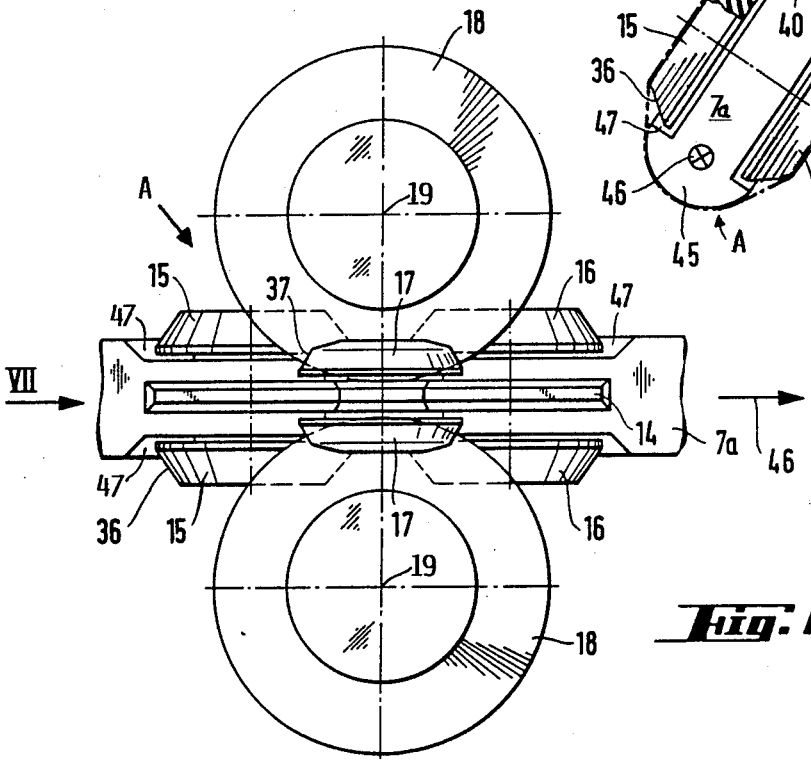
FIG. 6 is a view in the direction of the arrow VI in FIG. 4, also illustrating the roller position relative to the roller mounting plate.

As best seen in FIGS. 4, 5, and 6, the drive roller 18 reaches into the intermediate space between the rollers 15, 16, and 17. As mentioned, the drive roller 18 is mounted in a fixed position, but rotatable in the bearing 20 in the expander section 7*a* carrying the above mentioned spindle nut in a rigid position for cooperation with the adjustment spindle 5 in the adjustment mechanism, whereby the drive rollers also travel with the respective expander section in an adjustment movement.

The functional connection between the mounting frame section 21*a*, 21*b* and the respective roller arrangements A, B and C, D takes place by the frictional contact between the rotatively driven drive rollers 18. In other words, the mounting of the frame sections 7*a*, 7*b* on the width adjustment mechanism 3 does not interfere with the fabric 11 passing through between the rollers as shown, for example, in present FIG. 5. Thus, it is always assured that the expander sections 7*a*, 7*b* with their roller arrangements A, B and C, D have an exactly defined spacing to the frame sections 21*a*, 21*b* respectively, whereby the geometric relative position of the components to one another is maintained without any need for telescoping connection rods as are required in the prior art for interconnecting the left portion of the spreader with the right portion thereof.

The feed advance of the tubular fabric 11 takes place in such a way that the fabric passes over the non-driven idler guide rollers 13 onto the spreader section. Then, the fabric 11 is lead over the rollers 15, 16, 17 since the drive roller 18 reaches into the respective intermediate space between the guide rollers 15, 16 and the support roller 17, thereby providing a force transmitting drive for the fabric 11 through the non-directly driven rollers 15, 16, and 17 due to friction contact.

By using two roller arrangements vertically spaced from each other in each of the spreader sections 7*a* on the left side and 7*b* on the right side of the frame, it is possible to omit the upper guide roller 15 at the upper roller arrangement A or C and the lower guide roller 16 at the lower roller arrangement B or D or vice versa, namely to omit the lower guide roller 16 at the upper roller arrangement and the upper guide roller 15 at the lower roller arrangement, please see FIG. 1.

Figure 3:
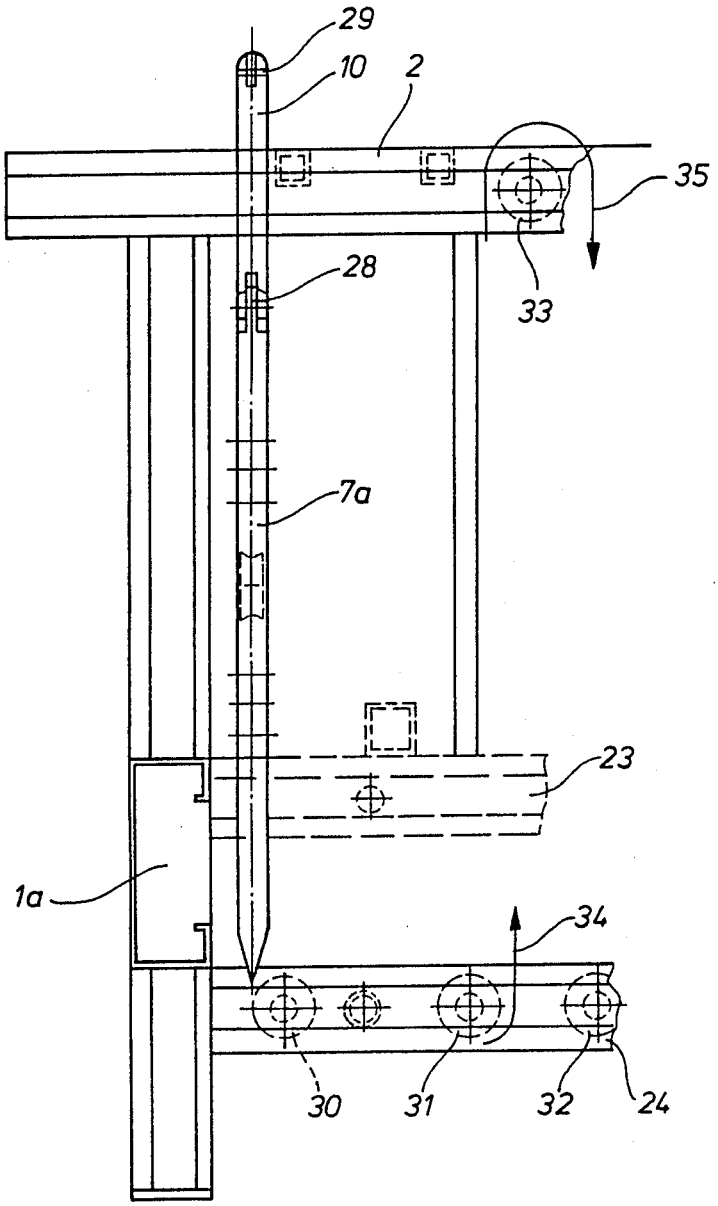
FIG. 3 is a schematic illustration in the same direction as FIG. 2, however, omitting the guide and drive elements.

FIG. 2 shows the side view of the expander as viewed in the direction of the arrow II in FIG. 1. The tubular fabric 11 travels in the direction of the arrow 9 onto the tie bars 10. It will be noted that the horizontal width as seen in FIG. 2 is relatively small. After the tubular fabric has passed through the expander, it is guided over rollers 30 and 31 and up again in the direction of the arrow 34 around a further guide roller 33 as indicated by the arrow 35, please see FIG. 3. Yet another guide roller 32 turns the fabric up again to cause a meandering travel path through a mercerizing bath not shown in any detail, since it is conventional. The guide rollers 30, 31, and 32 are mounted to a cross-beam 24, the upper guide rollers 33 are mounted to the cross-beam 2.

FIG. 2 further shows the closed or endless path of the drive chain 12 around the idler sprocket 27 around the drive sprocket 26 driven by the motor 22 and around the drive sprockets of each of the drive rollers 18. The above mentioned sprocket 25 is adjustable in its position and meshes with the drive chain 12 for tightening the drive chain. Incidentally, the cross-beams 23, 24, and 2 may be part of a mercerizing machine.

FIG. 4 shows somewhat schematically a side view of the roller arrangement A viewed in the same viewing direction as in FIG. 1, however on an enlarged scale. FIGS. 4 and 6 should be viewed together to note that the guide rollers 15 and 16 are arranged in pairs so that one roller of each pair is arranged on each side of the mounting plate 14 which in turn is secured to the expander section 7*a*. The drive rollers 18 are also arranged in pairs so that they can reach into the space between the guide rollers 15, 16 on the one hand, and the support rollers 17 on the other hand. The guide rollers 15 and 16 are mounted on fixed axes for rotation in a respective recess 47 in the expander section 7*a*. The mounting plate 14 is, for example, welded to the expander section 7*a* and carries the support roller 17, or rather the pair of support rollers 17, which are also rotatable about a fixed axis. The arrangement of the rollers is such that the support rollers 15 and 16 rotate in parallel vertical planes and so do the rollers 17. The drive rollers 18 also rotate in a vertical plane extending at 90° to the vertical planes of the guide and support rollers. The drive rollers 18 are also mounted on the expander section 7*a*. It is essential that the drive rollers always have a fixed constant spacing to the guide rollers 15 and 16 and to the support rollers 17. This spacing is adjustable, but it is maintained fixed for any particular type of fabric. The adjustment makes it possible to transport fabrics having different thicknesses. The adjustment of the rollers relative to one another is not shown in detail, since conventional means can be used for this purpose. FIG. 4 further shows that the center lines of the three roller pairs 15, 16, and 17, or rather the rotational axes of these rollers, are located at the tips of an equal sided triangle with the sides 52, 53, and 54. This arrangement is convenient, but not absolutely necessary.

By omitting one or the other of the guide rollers 15 or 16 as mentioned above, the symmetry shown in FIGS. 4 and 6 would be disturbed. However, the operability of the present roller arrangements does not depend on the shown symmetry. Rather, it depends on the cooperation of the drive rollers 18 with both the support rollers 17 and the guide rollers 15 or 16. Even a nonsymmetrical roller arrangement is possible provided that the drive rollers can always cooperate in the intended manner with one or two guide rollers and with the support roller or rollers. In a further embodiment the guide rollers 15 and 16 may have their rotational axis at the corners defining the baseline of a triangle having sides of unequal length. The support roller 17 can then be located at the tip of such an uneven sided triangle.

The above mentioned cooperation between the drive roller 18 on the one hand with the guide rollers and support rollers 15, 16, and 17 on the other hand, as taught by the invention, must be such that the drive roller reaches into the spacing between the guide rollers and support rollers to provide the force transmitting friction contact for a positive feed advance of the fabric 11 without any sagging and creasing. A sufficient depth of entry by the drive rollers into the just mentioned space is assured if the fabric is forced to follow a detour. Such detour is assured by providing the rollers with slanted circumferential surfaces as best seen in FIG. 5. The guide rollers 15 have slanted circumferential surfaces 36. The guide rollers 16 have also slanted circumferential surfaces 36 as shown in FIG. 4. However, in FIG. 5, the guide rollers 16 are not seen because they are located behind the guide rollers 15. The support rollers 17 have a slanted surface 37. The drive rollers 18 have two slanted surfaces to form a bulging rim 40. A contact surface 41 is formed between the slanted surfaces 36 of the guide rollers 15 and the slanted surface 38 of the drive roller 18. A further friction contact surface 42 is formed between the slanted surface 39 of the drive rollers 18 and the slanted surface 37 of the support rollers 17. A third friction roller contact surface 43 seen only in FIG. 4 is formed between the drive roller 18 and the guide roller 16. The roller contact surfaces are slightly spaced from each other so that the thickness of the tubular fabric 11 can pass through the spacing with the required friction contact. The length of the contact surfaces may be different between the support rollers 17 on the one hand, and the drive roller 18 on the other hand as compared to the length of the contact surface between the drive roller 18 and the guide rollers 15, 16. In any event, the slanted surfaces facing each other will preferably extend exactly in parallel with each other to precisely define the relative spacing between the cooperating surfaces in accordance with the thickness of the fabric. The parallel relationship between the surfaces assures a smooth transport of the fabric. The curved rim 40 is also desirable to avoid any sharp edge around which the fabric must bend. As seen in FIG. 5, the rollers are arranged symmetrically relative to a central plane 44 and the rollers transport the fabric in the direction of the arrow 46 shown in FIGS. 4 and 6. The symmetrical arrangement relative to the central plane 44 assures a smooth transport of the tubular fabric 11 through the expander without causing any creases in the fabric. The lateral edge 45 of the frame section 21*a* is rounded so that the fabric edge in turn can be smoothly stretched around this rounded edge 45. Incidentally, in FIG. 5 the fabric travels in the direction 46 that is perpendicularly to the plane defined by the sheet of the drawing.

Referring again to FIGS. 4 and 6, the guide rollers 15 and 16 are mounted partially recessed in recesses 47 provided on both sides and precisely symmetrically opposite each other and symmetrically relative to the mounting plate 14.

Figure 7:
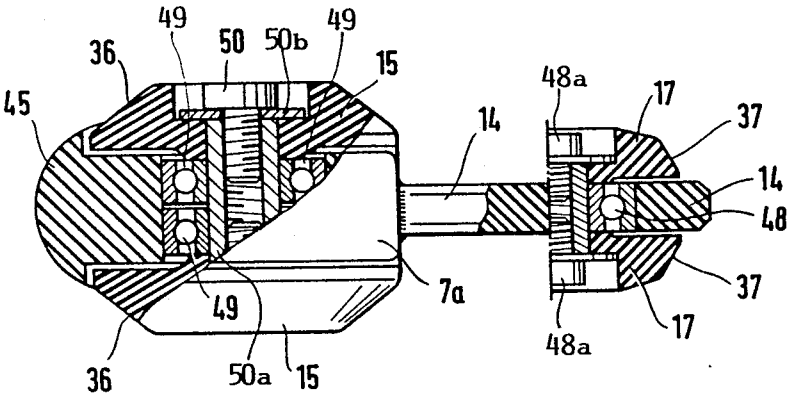
FIG. 7 is a view partially in section, along section line VII—VII in FIG. 1 to illustrate the mounting of the guide rollers and of the support rollers; said view being on an enlarged scale.

The illustration of FIG. 7 partially in section along section line VII—VII in FIG. 1 is a view somewhat similar to that of FIG. 5, but illustrating the mounting of the guide rollers 15 and of the support rollers 17. Only one half of the support rollers 17 is shown to illustrate the location of the mounting plate 14 which is, for example, welded to the expander section 7*a*. The two guide rollers 15 forming a pair are mounted in ball bearings 49 which in turn are mounted in the expander section 7*a*. The guide rollers 15 are mounted on a bushing 50*a* held in place by screws 50 screwed into the bushing 50*a* and holding down a washer 50*b* bearing against a shoulder of the respective roller 15. The guide rollers 16 are mounted in the same manner. The pair of support rollers 17 are mounted in ball bearings 48 held in the mounting plate 14. Screws 48*a* again hold the respective roller 17 in a bushing in the same way as the rollers 15 are held in the bushing 50*a*.

Figure 8:
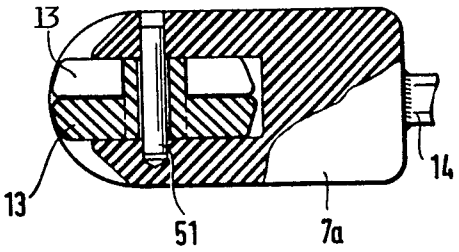
FIG. 8 is a view partially in section, along section line VIII—VIII in FIG. 1 to illustrate the mounting of idler guide rollers.

FIG. 8 shows the mounting of idler guide rollers 13 in the expander section 7*a* by means of bolts 51.

Although the invention has been described with reference to specific example embodiments, it will be appreciated that it is intended to cover all modifications and equivalents within the scope of the appended claims.

What we claim is:

1. An expander for tubular fabric, comprising a frame for supporting said expander on both sides, right and left, respectively, at least one roller arrangement (A, B, C, D) on each side of said frame, each roller arrangement including outer guide roller means around which the tubular fabric is laid and which spreads the tubular fabric, drive roller means, drive means for positively rotating said drive roller means, said drive roller means bearing with a frictional contact against said guide roller means through said tubular fabric for transporting the tubular fabric through said expander, and at least one support roller means arranged for taking up tension applied by said tubular fabric to said guide roller means, said drive roller means (18), with reference to said frame (1), bearing on an inside of said guide roller means (15, 16), said support roller means (17) supporting said drive roller means (18) by bearing against a circumference of said drive roller means (18) on a side facing away from said guide roller means (15, 16).

2. The expander of claim 1, wherein said drive roller means comprise two drive rollers (18) provided on both sides of a plane (44) defined by said guide roller means (15, 16) and by said support roller means (17), and wherein said drive roller means are so mounted that rotational axes of said drive roller means extend in parallel to said plane (44).

3. The expander of claim 1, wherein said guide roller means comprise two guide rollers (15, 16) mounted with a spacing between the two guide rollers, and wherein said support roller means (17) is arranged behind said guide rollers in a symmetrical arrangement as viewed from said frame into said expander.

4. The expander of claim 1, comprising at least two of said roller arrangements (A, B, C, D) on each side of said frame (1) arranged one behind the other in a transport direction (46) of said tubular fabric (11) through said expander.

5. The expander of claim 1 wherein said drive means comprise a separate drive mechanism including a separate drive motor (22) on each side of said frame (1) for positively, but separately driving said drive roller means (18) on each side of said expander.

6. The expander of claim 5 wherein said drive mechanism comprises a chain drive (12) for said drive roller means.

7. The expander of claim 1, wherein said guide roller means (15, 16), said support roller means (17), and said drive roller means (18) have slanted circumferential surfaces (36 to 39) for power transmission by frictional engagement between said rollers through said tubular fabric.

* * * * *

UNITED STATES PATENT AND TRADEMARK OFFICE

CERTIFICATE OF CORRECTION

PATENT NO. : 4,947,529

DATED : August 14, 1990

INVENTOR(S) : Werner Strudel, Oliver Hostenkamp

It is certified that error appears in the above-identified patent and that said Letters Patent is hereby corrected as shown below:

On the Cover Sheet above the line, replace "Strudel Werner et al." by --Strudel et al.--.

In [75] Inventors: replace "Strudel Werner" by --Werner Strudel--.

Claim 5, (Col. 8, line 64), after "claim 1" insert --,--.

Claim 6, (Col. 9, line 1), after "claim 5" insert --,--.

Signed and Sealed this

Tenth Day of September, 1991

*Attest:*

*Attesting Officer*

HARRY F. MANBECK, JR.

*Commissioner of Patents and Trademarks*